US009853394B2

(12) United States Patent
Hamilton-Gahart et al.

(10) Patent No.: US 9,853,394 B2
(45) Date of Patent: Dec. 26, 2017

(54) PRESSURE-BLOCKING FEEDTHRU WITH PRESSURE-BALANCED CABLE TERMINATIONS

(71) Applicant: ITT MANUFACTURING ENTERPRISES, LLC, Wilmington, DE (US)

(72) Inventors: Jeffrey Paul Hamilton-Gahart, Santa Rosa, CA (US); Charles Owen Campbell, Santa Rosa, CA (US); Roger C. Williams, Santa Rose, CA (US)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 764 days.

(21) Appl. No.: 14/268,441

(22) Filed: May 2, 2014

(65) Prior Publication Data

US 2015/0315877 A1 Nov. 5, 2015

(51) Int. Cl.
*H01R 13/533* (2006.01)
*E21B 41/00* (2006.01)
*E21B 17/02* (2006.01)

(52) U.S. Cl.
CPC ..... *H01R 13/533* (2013.01); *E21B 17/028* (2013.01); *E21B 41/00* (2013.01)

(58) Field of Classification Search
CPC ..... H01R 13/533; E21B 17/028
See application file for complete search history.

(56) References Cited

U.S. PATENT DOCUMENTS 3,641,479 A 2/1972 O'Brien et al.
3,652,777 A 3/1972 Elliott
3,729,699 A 4/1973 Briggs et al.
4,080,025 A 3/1978 Garnier et al.
(Continued)

FOREIGN PATENT DOCUMENTS

CN 100431226 C 11/2008
CN 101976782 A 2/2011
(Continued)

OTHER PUBLICATIONS

European Search Report dated Nov. 11, 2015 for corresponding European Patent Application No. EP 15 16 6198.

*Primary Examiner* — James Harvey
(74) *Attorney, Agent, or Firm* — Knobbe, Martens, Olson & Bear LLP

(57) ABSTRACT

A pressure-blocking feedthru that is exposable to varying temperatures and pressures includes various components. For example, the pressure-blocking feedthru might include pressure-blocking assemblies that each include a respective pressure-barrier shell and insulated pin assembly. The pressure-blocking feedthru also includes an interface assembly that couples the pressure-blocking assemblies to one another. The interface assembly includes a double-ended socket for coupling the insulated pin assemblies and a sleeve that circumscribes the doubled ended socket and at least part of the first and the second ceramic pin assemblies. In addition, the pressure-blocking assemblies might each be connected to a cable-connection assembly that employs a pressure-balanced cable termination.

19 Claims, 2 Drawing Sheets

(56) References Cited

U.S. PATENT DOCUMENTS 4,105,279 A 8/1978 Glotin et al.
4,142,770 A 3/1979 Butler, Jr. et al.
4,174,875 A 11/1979 Wilson et al.
4,390,229 A 6/1983 Chevalier
4,488,765 A 12/1984 Erbe
4,500,151 A 2/1985 Ayers
4,500,156 A 2/1985 Nguyen
4,515,426 A 5/1985 Bager
4,561,679 A 12/1985 Choate
4,589,717 A 5/1986 Pottier et al.
4,767,349 A 8/1988 Pottier et al.
4,780,574 A 10/1988 Neuroth
4,797,117 A 1/1989 Ayers
4,859,196 A 8/1989 Durando et al.
4,880,390 A 11/1989 Brackmann, Jr. et al.
4,948,377 A 8/1990 Cairns
5,334,032 A 8/1994 Myers et al.
5,645,442 A 7/1997 Cairns
5,760,334 A 6/1998 Ziemek
5,899,765 A 5/1999 Niekrasz et al.
5,907,128 A 5/1999 Lanan et al.
6,200,152 B1 3/2001 Hopper
6,326,550 B1 12/2001 Dyer et al.
6,559,383 B1 5/2003 Martin
6,780,037 B1 8/2004 Parmeter et al.
6,796,821 B2 9/2004 Cairns et al.
6,832,924 B2 12/2004 Maletzki et al.
6,916,193 B2 7/2005 Varreng et al.
6,932,636 B2 8/2005 Abbey et al.
7,112,080 B2 9/2006 Nicholson
7,367,848 B2 5/2008 John
7,528,513 B2 5/2009 Oh
7,533,461 B2 5/2009 Griffiths
7,695,301 B2 4/2010 Mudge, III et al.
7,737,361 B2 6/2010 Huspeni et al.
7,752,918 B2 * 7/2010 Davis ..... G01F 1/667 73/861.18
7,767,908 B2 8/2010 Sylvan
7,806,708 B2 10/2010 Erstad
7,828,573 B2 11/2010 Butaud
7,955,105 B2 6/2011 Maeland
7,959,454 B2 6/2011 Ramasubramanian et al.
8,025,506 B2 9/2011 Cairns
8,816,196 B2 8/2014 Williams et al.
2002/0046865 A1 4/2002 Bertini et al.
2003/0148638 A1 8/2003 McHugh et al.
2003/0172743 A1 * 9/2003 Ao ..... G01F 1/667 73/861.27
2004/0118590 A1 * 6/2004 Head ..... B29C 47/0016 174/105 R
2004/0211586 A1 10/2004 Sinha et al.
2004/0262025 A1 12/2004 Brandt et al.
2005/0056456 A1 3/2005 Ladie et al.
2005/0189130 A1 9/2005 Bertini et al.
2007/0010119 A1 * 1/2007 Hall ..... E21B 17/028 439/310
2007/0040459 A1 2/2007 Oh
2007/0169954 A1 7/2007 Bertini et al.
2009/0065237 A1 3/2009 Evoniuk et al.
2011/0130024 A1 * 6/2011 Cairns ..... H01R 13/523 439/271
2011/0306225 A1 12/2011 Chaize
2012/0097444 A1 4/2012 Hilberts et al.
2012/0100738 A1 4/2012 Palinkas et al.
2013/0183003 A1 7/2013 Cairns
2013/0206474 A1 8/2013 Skrypka et al.
2013/0312996 A1 11/2013 Nicholson
2014/0096992 A1 4/2014 Williams et al.
2014/0097001 A1 4/2014 Campbell et al.
2014/0099812 A1 4/2014 Burrow et al.
2015/0111420 A1 * 4/2015 Zillinger ..... E21B 43/123 439/521
2015/0315877 A1 * 11/2015 Hamilton-Gahart .... E21B 41/00 166/65.1
2016/0211052 A1 * 7/2016 Williams ..... E21B 17/028

FOREIGN PATENT DOCUMENTS

EP 0637675 2/1995
EP 0902505 A2 3/1999
EP 2386714 A2 11/2011
WO WO 02/103854 A2 12/2002
WO WO 2008/113026 A1 9/2008
WO WO 2009/097609 8/2009

* cited by examiner

PRESSURE-BLOCKING FEEDTHRU WITH PRESSURE-BALANCED CABLE TERMINATIONS

TECHNICAL FIELD

This invention generally relates to a feedthru for a well.

BACKGROUND

In some oil and gas well systems, power cables are run through certain components, such as the wellhead and the packer. As such, a feedthru is often used to safely and reliably pass electrical power through the pressure barrier. Among other things, the feedthru protects the connection between cables and restricts fluid from escaping the well. Some feedthrus are exposed to harsh environments that include varying pressures, temperatures, and deleterious gases.

SUMMARY

An embodiment of the present invention is directed to a pressure-blocking feedthru that is exposable to varying temperatures and pressures. In one embodiment, the pressure-blocking feedthru includes a first and a second pressure-blocking assembly, each of which includes a respective pressure-barrier shell and insulated pin assembly. The pressure-blocking feedthru also includes an interface assembly that couples the first and second pressure-blocking assemblies to one another. The interface assembly includes a double-ended socket for coupling the insulated pin assemblies and a sleeve that circumscribes the doubled ended socket and at least part of the first and the second insulated pin assemblies.

In another embodiment, the present invention includes a ceramic pin assembly for providing an electrical connection between two electrical conductors in a pressure-barrier feedthru. The ceramic pin assembly includes an elongated electrical conductor and pins that are coupled to respective ends of the elongated electrical conductor. The pin assembly also includes a ceramic insulating sleeve at least partially encasing the elongated electrical conductor, the ceramic sleeve having a larger-diameter middle portion that is flanked by a first and a second smaller-diameter portion. In addition, the pin assembly caps brazed to respective ends of the smaller-diameter portions of the ceramic insulating and coupled to respective pins.

In another embodiment, pressure-balanced cable terminations are integrated directly to ends of the pressure-blocking feedthru. The pressure-balanced cable terminations include a cable-housing tube partially encased in a connector shell, which is connectable to the pressure-barrier shell of the pressure-blocking assembly. A chamber is defined between the cable-housing tube and the connector shell and a shuttle is slidably positioned in the chamber together with viscous dielectric medium.

Embodiments of the invention are defined by the claims below, not this summary. A high-level overview of various aspects of the invention is provided here to provide an overview of the disclosure, and to introduce a selection of concepts that are further described below in the detailed-description section. This summary is not intended to identify key or essential features of the claimed subject matter, nor is it intended to be used as an aid in isolation to determine the scope of the claimed subject matter.

BRIEF DESCRIPTION OF THE DRAWINGS

Illustrative embodiments of the present invention are described in detail below with reference to the attached figures, which are incorporated herein by reference, wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies.

As indicated in other parts of this specification, the present invention is generally directed to a pressure-balanced feedthru that is usable to pass electrical power through components of a well system. The feedthru includes various components that block pressure and withstand temperature and pressure conditions experienced in a well environment. In addition, the feedthru is coupled to pressure-balanced cable terminations on each end to form an integrated safety-barrier penetration device. Typically, power cables are coupled to respective ends of the device to allow electrical power to pass from one side of a well component (e.g., wellhead) to the other side of a well component. Generally, field installation of the integrated device is achieved with minimal resources and processes, such as a crimped-on contact pin and cable-jacket preparation. In addition, the integrated device is configurable to be utilized with a wide variety of cables having different sizes, jacket configurations, materials, sheaths, or the like.

Figure 1A:
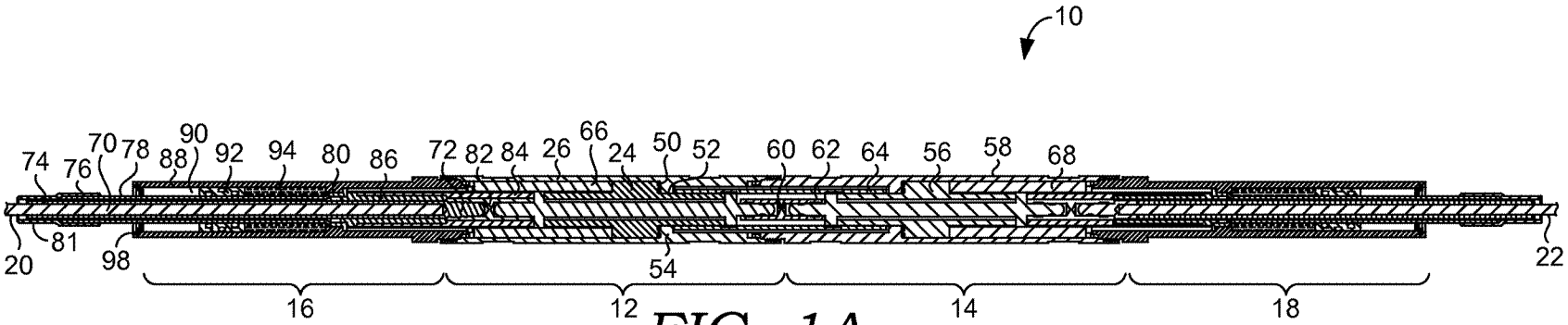
FIGS. 1A and 1B depict cross-section views of a pressure-blocking feedthru with pressure-balanced cable terminations in accordance with an embodiment of the present invention.
Figure 1B:
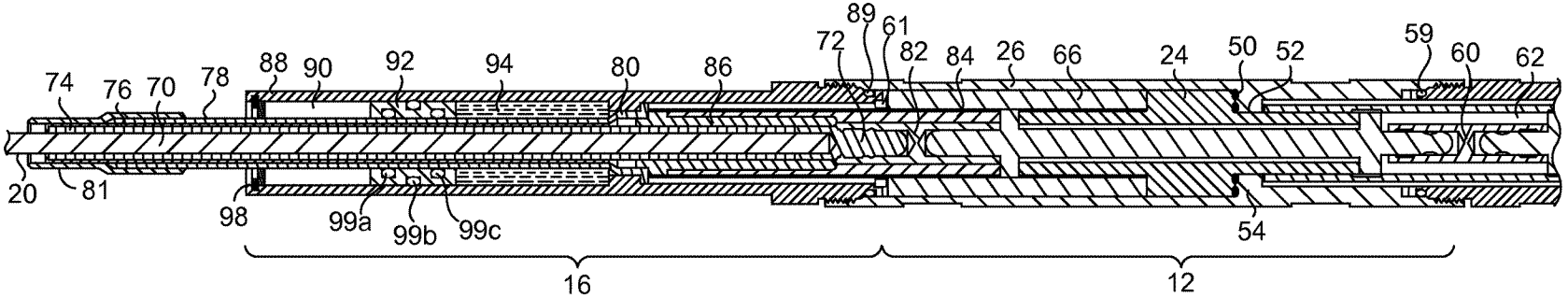

Referring now to FIGS. 1A and 1B, cross sections are depicted of a feedthru 10 in accordance with an embodiment of the present invention. Although FIGS. 1A and 1B include a cross-section depiction, many of the components are cylindrical in shape. FIG. 1A depicts the integrated unit as a whole, and illustrates the near symmetrical nature of the integrated unit. That is, FIG. 1A illustrates that a left side of the integrated unit (as depicted in FIG. 1A) and a right side of the integrated unit are substantially symmetrical, except the right side of the unit include a male-configured shell 58 and the left side includes a female-configured shell 26. To more clearly illustrate some of the smaller details of the feedthru 10, a larger depiction of the left side of the feedthru 10 is provided in FIG. 1B with the understanding that the right side includes many substantially similar components.

Referring to FIGS. 1A and 1B, the feedthru 10 generally includes a first pressure-blocking assembly 12 and a second pressure-blocking assembly 14. In addition, the feedthru includes a first pressure-balanced cable-connection assembly 16 and a second pressure-balanced cable-connection assembly 18, each of which is coupled to a respective pressure-blocking assembly. The cable-connection assemblies are also referred to as cable terminations in this description. Generally, a first cable 20 and a second cable 22 are positioned in a respective cable-connection assembly, and the pressure-blocking assemblies 12 and 14 allow electrical power to pass from one cable to the other. When used in a well system, the feedthru 10 might be positioned in a wellhead, a packer, or another component to allow electrical power to pass from one side to the other.

Figure 2:
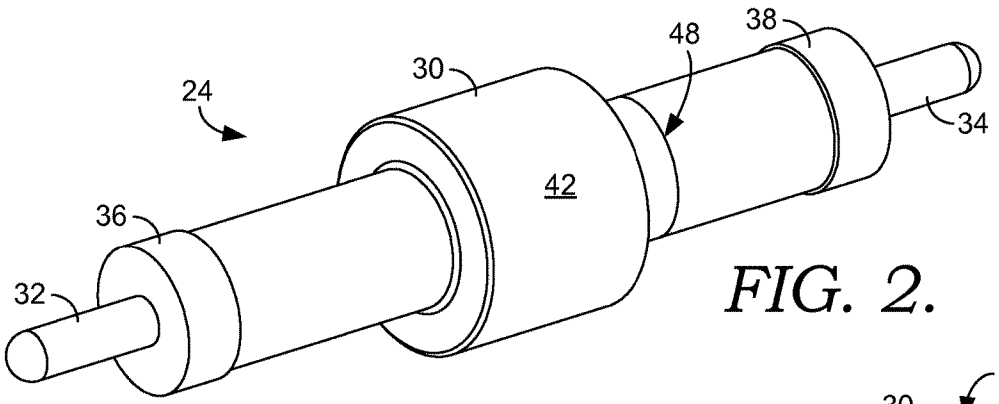
FIG. 2 depicts an isometric view of an insulated pin assembly in accordance with an embodiment of the present invention.
Figure 3:
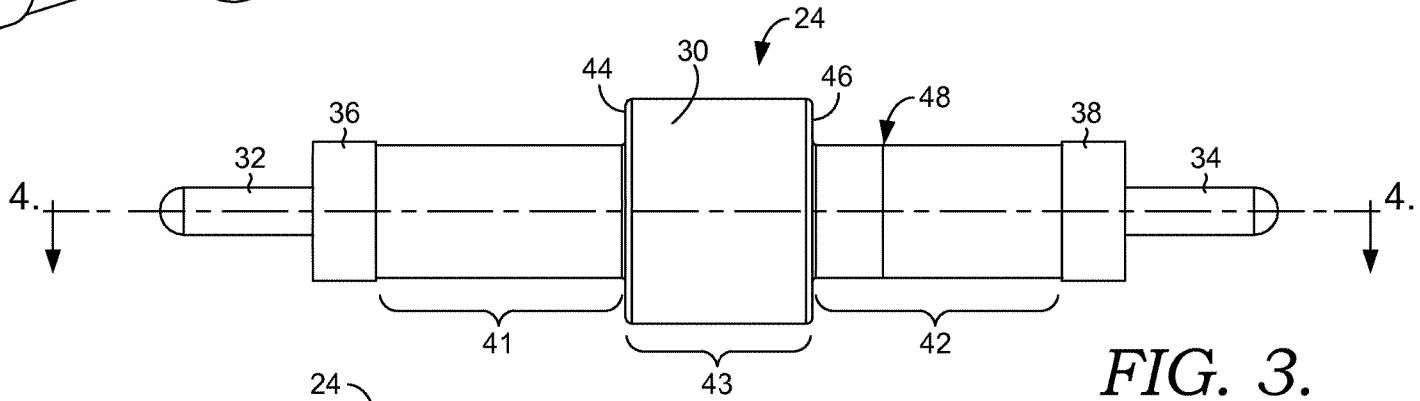
FIG. 3 depicts a side view of the insulated pin assembly in accordance with an embodiment of the present invention.
Figure 4:
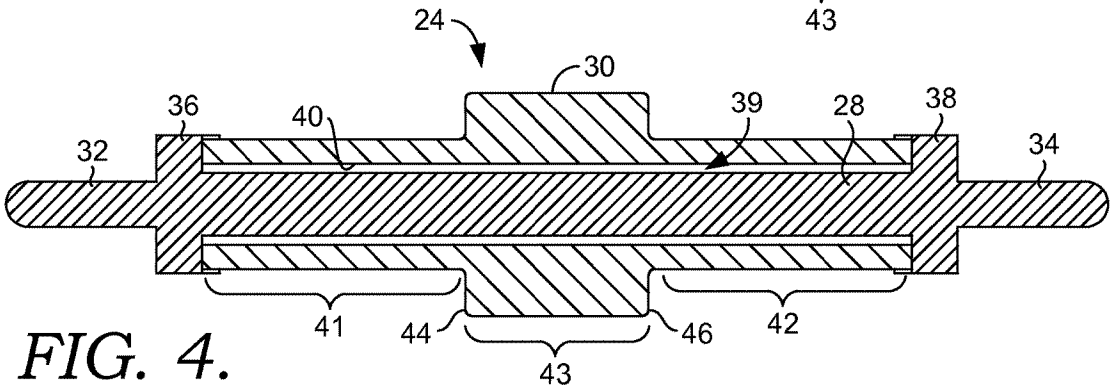
FIG. 4 depicts a cross-section view of the insulated pin assembly in accordance with an embodiment of the present invention.

The pressure-blocking assembly 12 includes an insulated pin assembly 24 that is positioned within a pressure-blocking shell 26. Referring now to FIGS. 2-4, the insulated pin assembly 24 will be described in more detail. The insulated pin assembly 24 includes an elongated electrical conductor 28 that is positioned within an insulator sleeve 30. Pins 32 and 34 are coupled to ends of the electrical conductor 28, and each pin 32 and 34 is coupled to the insulator sleeve 30 by a respective cap 36 and 38. In one embodiment, the insulator sleeve 30 includes a ceramic insulator sleeve, such that the insulated pin assembly 24 includes a ceramic pin assembly. Although a ceramic assembly is described with respect to some embodiments of the present invention, other insulating materials could be used as an alternative to, or in combination with, ceramic.

The electrical conductor 28 might include various types of conductors, and in one embodiment, the electrical conductor 28 includes a copper conductor. In another embodiment, the electrical conductor 28 includes a gold-plated, braided conductor. In addition, as depicted in FIG. 4, a gap 39 exists between the electrical conductor 28 and an inner surface 40 of the ceramic insulator sleeve 30. Among other things, the gap 39 provides a space into which the conductor 28 might thermally expand in some conditions, such as when a braided conductor unwinds at different temperatures.

The ceramic insulator sleeve 30 includes various elements. For example, the ceramic insulator sleeve 30 includes a through hole or hollow central portion extending from one side to the other side, and the electrical conductor 28 is positioned in the through hole. As such, the ceramic insulator sleeve includes an inner surface 40 that forms a circumscribing wall of the through hole and that faces the conductor 28. The ceramic insulator sleeve 30 also includes two smaller-diameter end portions 41 and 42 that flank a larger-diameter middle portion 43. The larger-diameter middle portion 43 is formed in part by external shoulders 44 and 46.

The ceramic insulator sleeve 30 is optimized in different ways. For example, at least part of the ceramic insulator 30 might be metalized. In one aspect, part or all of the inner surface 40 is metalized extending from one cap to another. Metalizing the inner surface 40 helps to provide a reliable connection when a signal or electricity is passed from one cable to another. That is, the metalized inner surface 40 helps to reduce the likelihood that a high electric field is created in the air gap 39, thereby contributing to ceramic dielectric breakdown. The metal is at the same potential as portions 36 and 38, such that there is no electric field across the gap 39.

In another aspect, at least part of an outer surface 52 is metalized. The portion of the outer surface 52 that is metalized might be selected for metallization based on other components of the feedthru that interface with, or contact, the ceramic pin assembly. For instance, in one aspect, the larger diameter portion 43 is metalized, including the shoulders 44 and 46. Metalizing these portions of the pin assembly helps to reduce corona discharge when the pin assembly is positioned in the feedthru 10. In addition, a portion of the smaller-diameter portion 42 is metalized extending from the shoulder 46 to a position 48 part-way down the opposing smaller-diameter end portion 42.

In a further embodiment a leaktight connection is utilized to attach the caps 36 and 38 and pins 32 and 34 to the ceramic insulator sleeve 30. For instance, in one embodiment the ceramic pin assembly is brazed or TIG welded, both of which contributes to a reliable connection along the ceramic pin assembly.

Referring back to FIGS. 1A and 1B, the pressure barrier shell 26 encases the ceramic pin assembly 24. In addition, one or more c-seals 50 are positioned at the interface between the shoulder 46 of the ceramic pin assembly 24 and an internal shoulder of the shell 26. The c-seals 50 might be metallic or any other suitable material. In one embodiment, c-seals are positioned back-to-back between an OD and ID placement. In an alternative embodiment, the c-seals are arranged in a front-to-front arrangement.

In addition, the metalized outer surface 52 of the ceramic pin assembly 24 (i.e., from the shoulder 46 to the position 48 in FIGS. 2-4) is also positioned at the interface with the shell 26 and abuts an inward protrusion 54 of the shell 26. The metalized outer surface 52 is positioned at the interface with the shell 26 to contribute to the pressure-barrier features of metallic c-seals. For instance, if the c-seals are silver-plated alloy (e.g., Inconel®), then plating on both the c-seals and the metalized portion of the ceramic pin assembly cooperate to improve the seal.

In an embodiment of the present invention, the second pressure-barrier assembly 14 also includes a ceramic pin assembly 56 that is within the pressure-barrier shell 58 and that is substantially similar to the ceramic pin assembly 24. The pressure-barrier shells 26 and 58 mechanically couple to one another, such as by mechanical threads or other fasteners. When the pressure-barrier shells 26 and 58 are coupled to one another, the ceramic pin assemblies 24 and 56 are electrically connected by way of an interface assembly.

The interface assembly that couples the ceramic pin assemblies 24 and 56 includes a double-sided sleeve 60. The sleeve 60 includes ports into which respective pins of the ceramic pin assemblies are inserted. In addition, the interface assembly includes an air gap 62 that surrounds the sleeve. The air gap 62 provides an inner cavity that is maintained at atmospheric pressure during operation. In contrast, the other portions of the pressure-barrier feedthru and pressure-balanced cable terminations are pressure balanced to the well pressure. The air gap 62 is further encased by a dielectric sleeve 64 constructed of a dielectric material. For example, the dielectric sleeve 64 might be constructed of polytetrafluoroethylene (PTFE), a molded on thermoplastic, or another viscous dielectric medium. The dielectric sleeve 64 is encased within the pressure-barrier shells 26 and 58 when they are coupled.

In an embodiment of the present invention, the pressure-barrier shells 26 and 58 prevent the feedthru from collapsing and protect the inner components of the feedthru from well conditions. The pressure-barrier shells 26 and 58 might be constructed of various materials, and in one embodiment, are constructed of a stainless steel. The stainless steel shells might be at least partially coated to provide additional characteristics, and in one embodiment, the shells are partially coated by molydisulfide.

In addition, the shells 26 and 58 might be coupled to one another using any suitable mechanical fastener. In FIG. 1, the shell 26 includes female threads that mate with male threads on the shell 58. In addition, a sealing ring 59 might be fitted in the interface between the shells 26 and 58. In one embodiment, the sealing ring 59 includes a backup O-ring constructed of perfluoro-elastomers (FFKM), or some other high-temperature elastomer.

In a further embodiment, each of the pressure-barrier assemblies 12 and 14 include additional components. For instance, each of the pressure-barrier assemblies 12 and 14 includes a ceramic sleeve 66 and 68 around a portion of the ceramic pin assembly 24 and 56. In one embodiment, a force-exertion component 61 is inserted between the ceramic sleeve 66 and 68 and a respective cable-connection shell (e.g., 88). The force-exertion component biases the ceramic sleeve and the ceramic pin assembly in a direction toward the c-seals, such that the c-seals function as a pressure block even if there are breaches in other portions of the feedthru. For instance, the force-exertion component 61 might be seated between an ID counter bore of the cable-connection shell 88 and the ceramic sleeve 66. In one embodiment, the force-exertion component provides at least about 15,000 lbs. of force. The force-exertion component might include various components, such as wave springs or Belleville washers. In one embodiment, the force-exertion component includes a stack of about 37 Belleville washers.

In addition, each of the pressure-barrier shells 26 and 58 includes a coupling mechanism for attachment to a respective cable-connection assembly 16 and 18. For example, both of the shells 26 and 58 are depicted to include female threads. Similar to the connection between shells 26 and 58, the metal-to-metal seal between the shell 88 and the shell 26 might also include a sealing ring 89, which includes a backup O-ring constructed of perfluoro-elastomers (FFKM), or some other high-temperature elastomer.

The cable-connection assemblies 16 and 18 are substantially similar and although only one of the cable-connection assemblies might be described or referenced, it is understood that the same description applies to the other cable-connection assembly. Each cable-connection mechanism 16 and 18 couples a respective cable to the feedthru 10.

The power cable 20 includes a copper conductor 70, a pin 72 that is fixedly mounted to the conductor 70, an insulative shield 74 that surrounds the copper conductor 70, and a lead barrier 76 that is positioned over the insulative shield 74. The lead barrier 76 protects the insulative shield 74 from exposure to harmful gasses and liquids that surround the power cable 20 in use. The lead barrier 76 is an optional component of the power cables and may be omitted.

The cable-connection assembly 16 also includes a cable-housing tube 78 that surrounds each lead barrier 76. The tube 78 may be composed of stainless steel, for example. A flange 80 is positioned at an end of the tube 78 and includes an external shoulder that engages an inner surface of the connection-assembly shell 88. The flange 80 is machined to include passageways to a hollow inner portion of the tube and the external shoulder is machined to include passageways to portions 83 of the feedthru between the shoulder and the c-seals. The tube 78 might not be considered as forming part of the respective power cables 20 and instead might be considered part of the cable-connection assembly 16. Alternatively, the tube 78 may be considered as a separable part that form part of the power cable assembly 20.

In another embodiment of the present invention, the cable-connection assembly 16 includes a rubber boot seal 81 fitted onto an end of the tube 78. The rubber boot seal 81 extends beyond the end of the tube 78, such that the rubber boot seal 81 also fits tightly against a cable (e.g., lead barrier 76) inserted into the tube 78. As such, the rubber boot seal 81 seals a juncture between the cable and the tube 78 to help protect the inner components of the feedthru from well conditions. In one embodiment, the rubber boot seal 81 is constructed of a pressure and temperature resistant material, such as a perfluoro-elastomers (FFKM), or other high temperature elastomer with an exo-skeleton of thermoplastic material to hold the outer-diameter of the boot in place and provide seal compression of the elastomer.

The feedthru 10 further comprises a double-ended socket 82, which electrically couples a pin 32 of the ceramic pin assembly 24 with the pin 72 of the cable 20. The double-ended socket 82 might include various types of sockets, such as a push-in-contact socket. In one embodiment, the socket 82 is positioned within a dielectric insulative sleeve 84, which has a hollow cylindrical body. One end of the dielectric insulative sleeve 84 is partially encased by the ceramic sleeve 66 when the cable-connection assembly 16 is coupled to the pressure-barrier assembly. The opposite end of the sleeve 84 partially surrounds and overlaps another dielectric insulative sleeve 86, and might be further protected with viscous dielectric medium filled between the sleeve 84 and the shell 88. The sleeve 86 includes a hollow cylindrical body and is partially sandwiched by the flange 80. The dielectric insulative sleeves 84 and 86 may be composed of any dielectric insulative material, such as a polyketone material.

The cable-connector shell 88 that encases and protects the cable-connection assembly 16 includes male threads that are threadedly connectable to the pressure-barrier shell 26. In addition, a sealing ring 89 might be provided at the interface between the cable-connection shell 88 and the pressure-barrier shell 26.

In the cable-connection assembly 16, the inner surface of the cable-connection shell 88 is space apart from the outer surface of the tube 78, such that a gap is between the two structures. In one embodiment, a tubular-shaped shuttle 92 is positioned in the gap between the cable-connection shell 88 and the tube 78, such that the space is divided into a pressure-balanced chamber 94 and an annular space 90. The shuttle 92 is sealingly compressed between an inner surface of the cable-connection shell 88 and outer surface of the tube 78. For instance, the shuttle 92 includes two inner sealing rings 99*a* and 99*c* that are retained on the shuttle and slidably engage the tube, and the shuttle 92 includes an outer sealing ring 99*b* retained on the shuttle 92 and slidably engaging the shell 88. The tube 78 provides a smooth surface upon which the shuttle 92 can translate.

The shuttle 92 divides the space between the pressure-balanced chamber 94 and the space 90. The chamber 94 is filled with a viscous dielectric medium, and the shuttle 92 blocks the passage of the viscous dielectric medium between the chamber 94 and the space 90. An end 98 of the space 90 is left at least partially open to allow pressure to enter the space 90. In operation, the shuttle 94 moves rightward (based on the view provided in FIG. 1) when it is exposed to external pressure as any air pockets or compressible elements within the medium will contract in volume. The assembly 10 is shown exposed to some external pressure in FIG. 1. The shuttle 92 may return to its initial position once the external pressure subsides. The pressure-balanced cable termination contributes to blocking well-fluid ingress since there is no driving pressure differential between the environment and the chamber.

In a further embodiment, the feedthru is pressure-balanced from the shuttle 94 to the c-seals 50. For instance, viscous dielectric medium is added to fill any gaps in the feedthru components extending from the shuttle 94 to the c-seals 50. As explained with respect to the tube 78, the flange 80 is machined to include passageways through which the viscous dielectric medium is allowed to flow.

The feedthru 10 includes various features that are helpful to provide resistance to the high-temperature and high-pressure well environment. For example, the boot 81 helps to provide protection at the juncture between an inserted cable and the cable-connection assembly. In addition, the pressure-blocking chamber and shuttle 92 help to further alleviate the effects of pressure fluctuations. Further, in the pressure-barrier assemblies 12 and 14, the ceramic pin assemblies provide a reliable connection that is resilient to extreme pressures and temperatures. In some testing, the feedthru has shown temperature ratings that exceed 500 degrees Fahrenheit and pressure ratings up to about 20,000 psi. Additional advantages based at least in part on the pressure-balanced cable terminations include high decompression rates, protection of cable insulation inside the cable-termination assemblies, and a gas permeation barrier.

In addition, the feedthru is easily modifiable to include varying lengths. For example, the feedthru might include relatively smaller lengths that are at or below about 3 feet. However, the length of the feedthru can be adjusted up to about 10 feet by modifying the dimensions of only three components: the pressure-barrier shell, the ceramic pin assembly, and the interface assembly. A substantially similar cable-connection assembly is still usable with the modified-dimension components.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A pressure-blocking feedthru comprising:
- a first pressure-blocking assembly comprising:
  - a first insulated pin assembly,
  - a first pressure barrier shell that encases the first insulated pin assembly and
  - a first metallic c-seal positioned between the first insulated pin assembly and the first pressure barrier shell;
- a second pressure-blocking assembly comprising:
  - a second insulated pin assembly,
  - a second pressure barrier shell that encases the second insulated pin assembly and that attaches to the first pressure barrier shell, and
  - a second metallic c-seal positioned between the second insulated pin assembly and second first pressure barrier shell; and
- an interface assembly that couples the first pressure-blocking assembly to the second pressure-blocking assembly and that comprises:
  - a first double-ended socket that couples the first insulated pin assembly to the second insulated pin assembly; and
  - a first sleeve that circumscribes the first doubled ended socket and at least part of the first and the second insulated pin assemblies.

2. The pressure-blocking feedthru of claim 1, wherein an air gap separates an inner surface of the first sleeve and an outer surface of the first doubled ended socket.

3. The pressure-blocking feedthru of claim 2, wherein the air gap is maintained at atmospheric pressure.

4. A pressure-blocking feedthru comprising:
- a pressure-blocking assembly comprising:
  - an insulated pin assembly, and
  - a pressure-barrier shell that encases the insulated pin assembly; and
- a cable-connection assembly that attaches to the pressure-blocking assembly and that comprises:
- a cable-housing tube,
- a connector shell that at least partially encases the cable-housing tube and that is connectable to the pressure-barrier shell,
- a chamber defined between the cable-housing tube and the connector shell, and
- a shuttle slidably coupled in the chamber.

5. The pressure-blocking feedthru of claim 1, wherein the first pressure-blocking assembly further comprises a first ceramic sleeve that encases a portion of the first insulated pin assembly and that is encased by the first pressure barrier shell, and wherein the second pressure-blocking assembly further comprises a second ceramic sleeve that encases a portion of the second insulated pin assembly and that is encased by the second pressure barrier shell.

6. The pressure-blocking feedthru of claim 1 further comprising,
- a first cable-connector assembly comprising:
  - a first connector shell that connects to the first pressure-barrier shell; and
  - a first cable-housing tube that is at least partially encased by the first connector shell and that provides a through channel to receive a first cable assembly; and
- a second cable-connector assembly comprising:
  - a second connector shell that connects to the second pressure-barrier shell; and
  - a second cable-housing tube that is at least partially encased by the second connector shell and that provides a through channel to receive a second cable assembly.

7. The pressure-blocking feedthru of claim 6 further comprising,
- a first chamber that is positioned between the first connector shell and the first cable-housing tube and that contains a viscous dielectric medium;
- a first shuttle positioned in the first chamber;
- a second chamber that is positioned between the second connector shell and the second cable-housing tube and that contains a viscous dielectric medium; and
- a second shuttle positioned in the first chamber.

8. The pressure-blocking feedthru of claim 7, wherein the first shuttle and the second shuttle each includes at least one interior ring that slidably engages an outer surface of a respective cable-housing tube and at least one exterior ring that slidably engages an inner surface of a respective connector shell.

9. The pressure-blocking feedthru of claim 7, wherein the viscous dielectric medium is contained between the first shuttle and the first metallic c-seal and between the second shuttle and the second metallic c-seal.

10. The pressure-blocking feedthru of claim 8 further comprising, a first tubular boot seal coupled to an end of the first cable-housing tube and a second tubular boot seal coupled to an end of the second cable-housing tube.

11. A pressure-blocking feedthru comprising:

a first pressure-blocking assembly comprising a first insulated pin assembly and a first pressure-barrier shell that encases the first insulated pin assembly;

a second pressure-blocking assembly that comprises a second insulated pin assembly and a second pressure-barrier shell that encases the second insulated pin assembly, wherein the first and second pressure-barrier shells attach to one another and enclose a central cavity;

a double-ended socket that couples the first and second insulated pin assemblies to one another and is housed in the central cavity;

a first cable-connection assembly attachable to the first pressure-blocking assembly and comprising a first cable-housing tube, a first connector shell that at least partially encases the cable-housing tube and that is connectable to the respective pressure-barrier shell, a first chamber defined between the cable-housing tube and the connector shell, and a first shuttle slidably coupled in the first chamber; and a second cable-connection assembly attachable to the second pressure-blocking assembly and comprising a second cable-housing tube, a second connector shell that at least partially encases the second cable-housing tube and that is connectable to the second pressure-barrier shell, a second chamber defined between the second cable-housing tube and the second connector shell, and a second shuttle slidably coupled in the second chamber.

12. The pressure-blocking feedthru of claim 11, wherein the first insulated pin assembly includes a first ceramic insulating sleeve at least partially encasing a first elongated electrical conductor, the first ceramic sleeve having a first larger-diameter middle portion that is flanked by smaller-diameter portions, the first larger-diameter middle portion abutting an internal shoulder of the first pressure-barrier shell, and wherein the second insulated pin assembly includes a second ceramic insulating sleeve at least partially encasing a second elongated electrical conductor, the second ceramic sleeve having a second larger-diameter middle portion that is flanked by smaller-diameter portions, the second larger-diameter middle portion abutting an internal shoulder of the second pressure-barrier shell.

13. The pressure-blocking feedthru of claim 12 further comprising, a first set of one or more metallic c-seals positioned between a shoulder of the first larger-diameter middle portion and the internal shoulder of the first pressure-barrier shell, and a second set of one or more metallic c-seals positioned between a shoulder of the second larger-diameter middle portion and the internal shoulder of the second pressure-barrier shell.

14. The pressure-blocking feedthru of claim 13 further comprising, a first viscous dielectric medium contained between the first shuttle and the first set of one or more metallic c-seals, and a second viscous dielectric medium contained between the second shuttle and the second set of one or more metallic c-seals.

15. The pressure-blocking feedthru of claim 11 further comprising, a sleeve housed in the central cavity and circumscribing the double-ended socket, wherein an air gap separates an inner surface of the sleeve and an outer surface of the doubled ended socket, and wherein the air gap is maintained at atmospheric pressure.

16. The pressure-blocking feedthru of claim 4 further comprising, a tubular boot seal coupled to an end of the cable-housing tube.

17. The pressure-blocking feedthru of claim 4 further comprising, an interface assembly that partially couples the pressure-blocking assembly to the cable-connection assembly and that comprises:

a double-sided socket that attaches to the insulated pin assembly;

a dielectric sleeve at least partially encasing the double-sided socket; and a ceramic sleeve positioned between at least part of the dielectric sleeve and the pressure-barrier shell.

18. The pressure-blocking feedthru of claim 4, wherein the shuttle comprises a first and a second inner sealing ring slidably retaining the shuttle against the cable-housing tube and an outer sealing ring slidably for slidably engaging the connector shell.

19. The pressure-blocking feedthru of claim 4, wherein the pressure-blocking assembly further comprises a metallic c-seal positioned between the insulated pin assembly and the pressure-barrier shell.

* * * * *